United States Patent [19]

Olsen

[11] 4,229,722

[45] Oct. 21, 1980

[54] WIRE COIL ASSEMBLY FOR AN ELECTRICAL CIRCUIT

[75] Inventor: Perry C. Olsen, Noblesville, Ind.

[73] Assignee: RCA Corporation, New York, N.Y.

[21] Appl. No.: 54,094

[22] Filed: Jul. 2, 1979

Related U.S. Application Data

[62] Division of Ser. No. 909,038, May 24, 1978, abandoned.

[51] Int. Cl.[3] ..... H01F 15/10

[52] U.S. Cl. ..... 336/192; 336/208

[58] Field of Search ..... 336/192, 208, 198, 65; 310/194, 71

[56] References Cited

U.S. PATENT DOCUMENTS

| | | | |
|---|---|---|---|
| 2,648,031 | 8/1953 | Lang et al. | 336/192 X |
| 2,751,563 | 6/1956 | Willyard et al. | 336/65 |
| 3,083,930 | 4/1963 | Brekke | 336/192 X |
| 3,117,294 | 1/1964 | Muszynski et al. | 336/192 |
| 3,359,395 | 12/1967 | Bruce | 336/192 X |
| 3,555,477 | 1/1971 | Hildebrandt | 336/192 |
| 3,731,245 | 5/1973 | Roslin | 336/192 |
| 3,735,307 | 5/1973 | De Groot | 336/192 |
| 3,792,398 | 2/1974 | Norlin et al. | 336/192 |
| 4,095,206 | 6/1978 | Hishiki | 336/192 X |
| 4,109,224 | 8/1978 | Liautaud | 336/208 |

FOREIGN PATENT DOCUMENTS

| | | | |
|---|---|---|---|
| 2226034 | 12/1973 | Fed. Rep. of Germany | 336/192 |
| 873467 | 7/1961 | United Kingdom | 336/192 |

*Primary Examiner*—Thomas J. Kozma

*Attorney, Agent, or Firm*—Eugene M. Whitacre; William H. Meagher; Ronald H. Kurdyla

[57] ABSTRACT

A wire coil assembly including a form for supporting a wire wound thereon, a base for the wire form, and terminals attached to the base and to which the ends of the wire are respectively connected. The base includes a number of exposed grooves through which the wire ends are routed from the wire form to the terminals. The grooves are configured to contain the wire ends, thereby eliminating exposed wire ends which would otherwise be susceptible of stress breakage when the coil assembly is handled.

2 Claims, 6 Drawing Figures

WIRE COIL ASSEMBLY FOR AN ELECTRICAL CIRCUIT

Figure 1B:
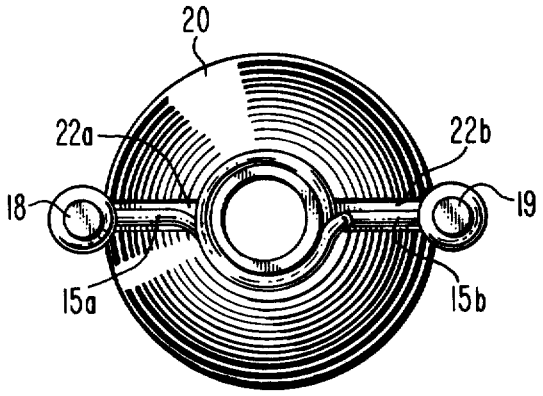

This is a division of application Ser. No. 909,038, filed May 24, 1978, now abandoned.

This invention relates to an electrical circuit component comprising a wire coil assembly configured to reduce the possibility of wire breakage when the assembly is handled.

A wire coil assembly for use in electrical circuits typically comprises a base to which appropriate conductive terminals are fastened, and a column-shaped wire form about which a conductive wire is wound in accordance with the intended use of the coil in a given circuit. The ends of the wires are connected to the terminals at the base. Wire coil assemblies have numerous uses in electrical circuits, such as tuning coils, chokes, and transformers in radio frequency (RF) circuits as well as in aduio frequency circuits. Examples of such coil assemblies are shown in U.S. Pat. Nos. 2,648,031; 2,751,563 and 3,555,477.

The wire employed with these assemblies is often very fine and therefore susceptible of breakage when the coil assembly is being handled. Illustratively, when the coil is being mounted on a printed circuit board containing circuits with which the coil is to operate, wire breakage can occur when the wire form about which the wire is wound is caused to move or flex relative to the base due to the pressure exerted as the coil assembly is being inserted. The wire ends connected to the terminals may then break under stress.

If the wire ends connected to the terminals are left slack such that movement of the wire form relative to the base will not stress the wire ends to the point of breaking (e.g., see U.S. Pat. No. 3,555,477), the slack wire ends may be broken by finger or fingernail pressure exerted by the person attempting to mount the coil assembly by hand. The slack wire ends can also be broken when the coil assembly is being removed from a receptacle containing other coil assemblies or a variety of other circuit elements having protruding terminals or wires. In this event, the slack wires can become entangled with the protruding terminals or wires of the other elements, and can be broken if sufficient force is used to remove the entangled coil assembly from the receptacle.

The coil assembly could be protected by means of a suitable housing, but this undesirably adds to the size, cost and complexity of the assembly.

It is therefore desirable to reduce the possibility of such wire breakage to an acceptable minimum in a manner which does not unduly increase the size, cost or complexity of the coil assembly.

A wire coil assembly in accordance with the invention comprises a body form about which a wire having end portions in wound, a mounting base secured to one end of the body form, and a plurality of terminals secured to the base. The mounting base includes a plurality of exposed slots extending from respective points in the vicinity of the juncture of the base and the body form, toward the periphery of the base. The end portions of the wire are routed from respective points in the vicinity of the juncture of the body form and base, through respective ones of the slots, to respective ones of the terminals.

Figure 1A:
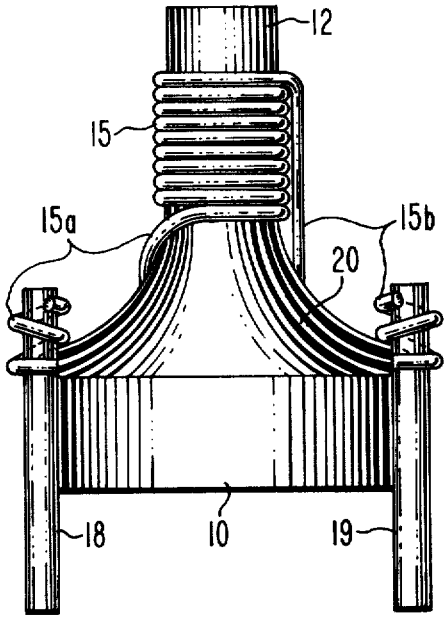
Figure 2B:
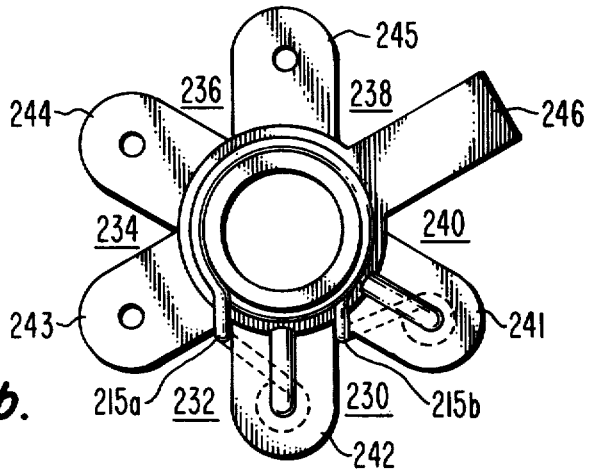
Figure 2A:
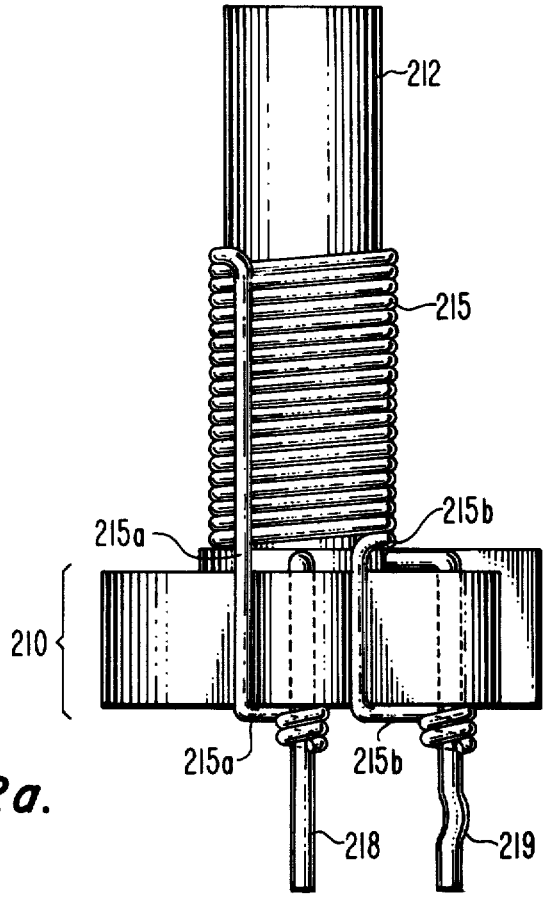
Figure 3B:
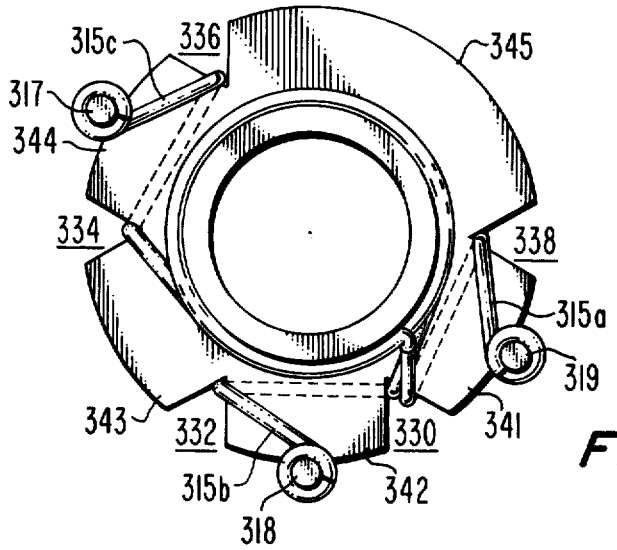
Figure 3A:
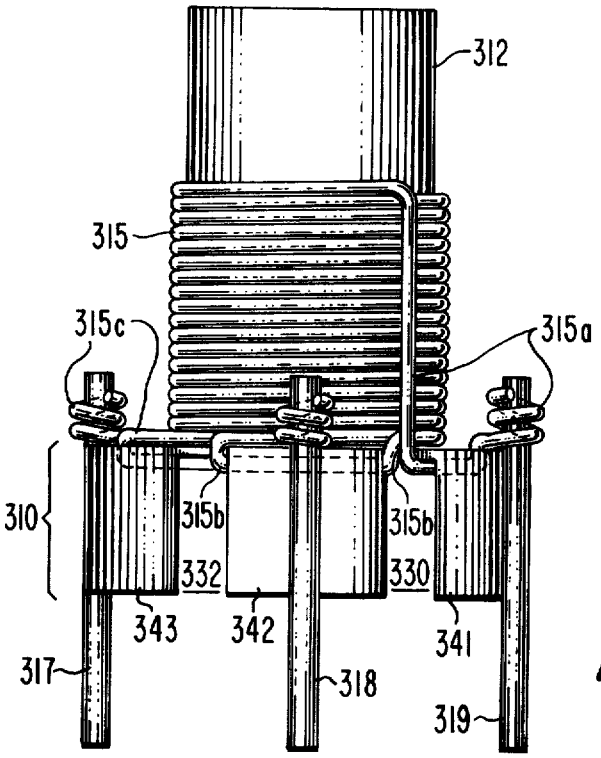

In the drawing:

FIGS. 1*a* and 1*b* respectively show side and top views of a wire coil assembly constructed in accordance with the present invention;

FIGS. 2*a* and 2*b* respectively show side and top views of an alternate embodiment of the invention; and FIGS. 3*a* and 3*b* respectively show side and top views of a further embodiment of the invention.

Certain features of the wire coil assemblies shown in the drawing have been exaggerated somewhat in the interest of clarity.

Referring to FIG. 1*a* together with FIG. 1*b*, a coil assembly includes a disc-shaped base 10 of a given thickness and a pair of conductive terminals or pins 18 and 19 attached to base 10. The assembly also includes a cylindrical wire support form 12 oriented vertically with respect to base 10 and disposed thereon, and about which a conductive wire coil 15 is wound. Wire form 12 typically is hollow and may include provision for an adjustable tuning slug (not shown) as is known. Base 10 and wire form 12 may be of any suitable material having insulating properties (e.g., plastic), and may be formed as a single molded structure or as separate elements. In the latter event, wire form 12 would be affixed to base 10 with any suitable adhesive.

The coil assembly also includes a fillet (e.g., of non-conductive material) 20 disposed about the junction of base 10 and wire form 12 as shown. In this example, fillet 20 completely overlies the upper major surface of base 10, and also overlies the lower portion of form 12. Fillet 20 can be formed with base 10 and wire form 12 as a single molded structure of the same insulating material, or it can be formed separately by depositing a suitable insulating filler material such as plastic at the junction of base 10 and wire form 12 to yield the configuration shown. In the latter instance and when base 10 and wire form 12 are fabricated separately, fillet 20 can serve to join base 10 and wire form 12 together, to thereby substantially eliminate the possibility of base 10 and wire form 12 moving relative to each other (e.g., when the assembly is being inserted in a printed circuit board).

It is noted that fillet 20 contains exposed grooves or slots 22*a* and 22*b* (see FIG. 1*b*), extending from the point where wire form 12 meets base 10, to the outer edge of base 10 on the upper surface thereof. The ends 15*a* and 15*b* of wire 15 are routed through grooves 22*a* and 22*b*, respectively, as they are dressed from wire form 12 to respective terminals 18 and 19, to which they are suitably fastened by means of solder or wire wrapping techniques. The depth of each groove preferably is substantially equal to or greater than the diameter of the wire (or wires) placed in each groove, so that the wires are contained within the respective grooves. The wire ends within the grooves may be coated with a suitable non-conductive adhesive film to prevent movement of the wires out of the grooves. Wire coil 15 is typically coated with a similar adhesive material to prevent the wire coil from unravelling.

With wire ends 15*a* and 15*b* being arranged within grooves 22*a* and 22*b* of fillet 20 as shown, the wire ends are protected from potential damage due to stress breakage when the coil assembly is being handled or mounted, as mentioned previously. This result is also achieved with the coil assembly shown in FIGS. 2*a* and 2*b*.

The coil assembly shown in FIGS. 2*a* and 2*b* consists of a segmented base 210 and a wire form 212 about which a wire coil 215 is wound, formed as a single molded structure of insulating material such as plastic. Base 210 is configured to define a plurality of radially protruding segments 241–246, and a plurality of exposed slots 230, 232, 234, 236, 238 and 240 between adjacent base segments. Terminals 218 and 219 are inserted within base segments 242 and 241, respectively. Each slot extends from a point in the vicinity of where base 210 meets wire form 212, adjacent to the bottom of wire form 212, to the outer edge of the associated base segments. Wire ends 215*a* and 215*b* of wire coil 215 are routed downwardly from the bottom of wire form 212 into respective slots 232 and 230, which then contain these wire ends. Wire ends 215*a* and 215*b* are then appropriately connected to associated pins 218 and 219 at the bottom of base 210. As in the previous example, the wire ends dressed within slots 230 and 232 as well as wire coil 215 preferably are coated with an adhesive film.

In addition to significantly reducing the risk of wire stress breakage, it is noted that the segmented configuration of base 210 provides a convenient means of attaching pin connectors 218 and 219, which are inserted into respective segments 242 and 241 of base 210 in the manner shown.

FIGS. 3*a* and 3*b* also illustrate a wire coil assembly having a segmented base 310 defining a plurality of exposed slots 341–345 separating adjacent base segments, and a wire coil form 312 with a wire coil 315 wound thereon. In this example, base 310 and coil form 312 are fabricated as a single molded unit of plastic or other suitable non-conductive material, with the area beneath coil form 312 and behind each of the base segments being hollow. Connecting terminals 317, 318 and 319 are fastened to base segments 344, 342 and 341, respectively.

Wire coil 315 includes wire ends 315*a*, 315*b* and 315*c*. Wire end 315*a* is dressed from the top of wire coil 315, down through the V-shaped portion of slot 330 (see FIG. 3*b*), behind base segment 341, then up through adjacent slot 338, after which it is affixed to terminal 319. Wire end 315*b* is dressed from the bottom of wire coil 315, down through the V-shaped portion of slot 330, behind base segment 342, then up through adjacent slot 332 after which it is affixed to terminal 318. Similarly, wire end 315*c* is dressed from the bottom of coil 315, through slot 334, behind base segment 344, then through slot 336 to terminal 317. In this regard it is noted that the manner in which wire ends 315*a*, 315*b* and 315*c* are dressed behind respective base segments 341, 342 and 344 provides an additional measure of protection.

For each of the coil assemblies discussed, the wire ends which are connected to the terminals are protected from damage due to stress breakage when the coil assemblies are being handled or mounted. The manner in which this is accomplished by means of the exposed slots in the base also facilitates the manufacture of the coil assemblies, since the exposed slots permit the wire ends to be easily and quickly dressed from the wire coil form to the connecting terminals during manufacture. Also, the exposed slots can be fabricated without difficulty and at little or no additional cost, especially when the coil form and base are fabricated as a single molded unit.

What is claimed is:

1. A wire coil assembly comprising:

a body form about which a wire having end portions is wound;

mounting means secured to an end of said body form for providing a mounting base for said body form;

fillet means disposed at the juncture of said body form and said mounting means, and overlying a surface of said mounting means which contacts said body form, said fillet means having a plurality of exposed grooves extending in different directions from respective points at the juncture of said mounting means and said body form toward the periphery of said mounting means;

a plurality of terminals secured to said mounting means; and wherein said end portions of said wire are routed from respective points in the vicinity of the juncture of said fillet means and said body form, through respective ones of said grooves, to respective ones of said terminals.

2. Apparatus according to claim 1 wherein:

said body form fillet means and mounting means comprise respective portions of a common body of nonconductive material.

* * * * *